US005853040A

United States Patent [19]

Benthin

[11] Patent Number: 5,853,040

[45] Date of Patent: Dec. 29, 1998

[54] CASSETTE BLIND WITH BRAKE COUPLING

[75] Inventor: Siegfried Benthin, Bremerhaven, Germany

[73] Assignee: Benthin Aktiengesellschaft, Bremerhaven, Germany

[21] Appl. No.: 790,625

[22] Filed: Jan. 29, 1997

Related U.S. Application Data

[63] Continuation-in-part of Ser. No. 532,416, Sep. 22, 1995, abandoned.

[51] Int. Cl.[6] ..... E06B 9/56

[52] U.S. Cl. ..... 160/299; 160/291; 160/305

[58] Field of Search ..... 160/291, 299, 160/305, 298, 319; 192/54, 93 A

[56] References Cited

U.S. PATENT DOCUMENTS

| | | | |
|---|---|---|---|
| 300,841 | 6/1884 | Briggs | 160/291 X |
| 1,373,641 | 4/1921 | Williams | 160/291 X |
| 1,566,248 | 12/1925 | Hendricks et al. | 160/291 |
| 1,841,384 | 1/1932 | Schmelz | 160/291 |
| 4,433,765 | 2/1984 | Rude et al. | 192/41 |
| 4,519,487 | 5/1985 | Florin | 192/36 |
| 4,534,396 | 8/1985 | Jung | 160/298 |
| 5,078,198 | 1/1992 | Tedeschi | 160/315 |
| 5,443,109 | 8/1995 | Benthin | 160/298 |
| 5,481,943 | 1/1996 | Kraeutler | 160/291 X |
| 5,507,374 | 4/1996 | Rude | 160/298 X |

FOREIGN PATENT DOCUMENTS

| | | | |
|---|---|---|---|
| 621392 | 10/1994 | European Pat. Off. | 160/291 |

*Primary Examiner*—Daniel P. Stodola
*Assistant Examiner*—Bruce A. Lev
*Attorney, Agent, or Firm*—McGlew and Tuttle

[57] ABSTRACT

A cassette blind with a weighting profile at the lower end of a set of blinds and a blind drive, in which coupling elements with a winding shaft mounted in the cassette profile. Complementary coupling elements with a drive member and complementary coupling elements at a pin which can be stationarily fastened are arranged, wherein coupling elements of the drive member and of the winding shaft mutually engage each other during a rotary movement of the drive member in the winding-up direction of the blinds, and coupling elements of the winding shaft and of the pin mutually engage each other in the opposite direction. The coupling elements at the winding shaft are arranged rotatably over a predetermined angle against spring action in the winding-up direction of the blinds in order to achieve a torsionally elastic tensioning of the weighting profile at the cassette profile at the end of the winding-up movement of the blinds.

18 Claims, 3 Drawing Sheets

CASSETTE BLIND WITH BRAKE COUPLING

This is a continuation-in-part application of application Ser. No. 08/532,416 filed Sep. 22, 1995 now abandoned.

FIELD OF THE INVENTION

The present invention pertains to a cassette blind with a winding shaft that is connected by coupling elements to a stationary pin and to a drive member, where the coupling elements to the drive member engage in a winding up direction of the blind, and the coupling element connected to the stationary pin engage in an unwinding direction of the blind. In particular the present invention relates to such a blind where the winding shaft is prevented from unrolling at the end of the winding up.

BACKGROUND OF THE INVENTION

A cassette blind is known from DE 42 39 507-A1 and the corresponding U.S. Pat. No. 5,443,109. This document describes friction disks, which are alternately fixed with teeth in axial grooves on the outer circumference of a stationarily anchored pin and in axial grooves on the inner circumference of a tubular housing which can be coupled with the drive member in the direction of rotation, and which can be pressed against each other by axial forces with an axial displacement. To achieve this, one of two end disks which are axially displaceable on the pin are tensioned by a torque spring in the direction of rotation within a predetermined angle of rotation, and the other end disk is only axially displaceable. Relatively strong coupling or braking forces are initiated due to the relatively weak torque spring, so that such a drive runs smoothly and is especially suitable for high blind weights. The problem arises in such and similar cassette blinds that even though the weighting profile arranged at the lower edge of the set of blinds can be pulled against the cassette profile of the cassette accommodating the winding shaft and the blind a wound up on it when the blinds are being pulled up, it drops back somewhat after the driving forces are eliminated, so that a narrow strip of the set of blinds again becomes visible between the weighting profile and the cassette profile. This is frequently undesirable, because it compromises the appearance of the pulled-up cassette-type blind.

SUMMARY AND OBJECTS OF THE INVENTION

The object of the present invention is therefore to design the drive means of the blind such that the weighting profile no longer drops back after the blind has been pulled up.

The present invention includes a winding shaft which is connected to a stationary pin by a pin coupling means, and to a drive member by a drive coupling means. The drive coupling means engages the drive member to the winding shaft during rotary movement of the drive means in a winding up direction, and the pin coupling means engages the winding shaft to the stationary pin during an unwinding direction. The coupling elements are arranged on the winding shaft rotatably over a predetermined angle against the action of the spring in the winding-up direction of the blinds.

It is achieved due to this design that the drive member can still be rotated further additionally by a predetermined angle against the action of the spring at the end of the winding-up movement, when the weighting profile has already come into contact with the cassette profile. When the driving force applied manually or by a motor ceases to act, the weighting profile is held by the force of the spring against the cassette profile, so that the elements of the now active brake coupling are movable within the predetermined angle of rotation for mutual engagement. The spring counteracts the weight of the blinds and can be designed as a relatively weak spring, so that the weight of the blinds pulls the coupling elements attached to the winding shaft into one stop position. The spring comes into action only at the end of the winding-up movement of the blinds, so that it pulls the coupling elements into the other stop position of the predetermined angle of rotation, so that the coupling elements are rotatable in relation to one another within the predetermined angle when the weighting profile is already in contact with the cassette profile.

The angle of rotation of the winding shaft in relation to the coupling elements associated with it, is greater than the switching angle necessary for the engagement of the coupling elements acting between the winding shaft and the pin. Preferably the coupling elements include inner and outer sleeves which are mounted concentrically one inside the other and are rotatable with respect to one another. These inner and outer sleeves are tensioned by the torsion spring against the direction of rotation of the drive member during the winding-up of the blinds. The inner and outer sleeves are provided on the winding shaft. The outer sleeve is non-rotatably connected to the winding shaft, and the inner sleeve is connected rotatably between stops to the driving member. Coupling elements between the pin and the winding shaft include first and second brake disks which are alternating connected non-rotatably to the pin and to the winding shaft. A cam means axially biases the first and second sets of brake disks against each other.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DETAILED DESCRIPTION OF THE PREFERRED EMBODIMENT

Figure 1:
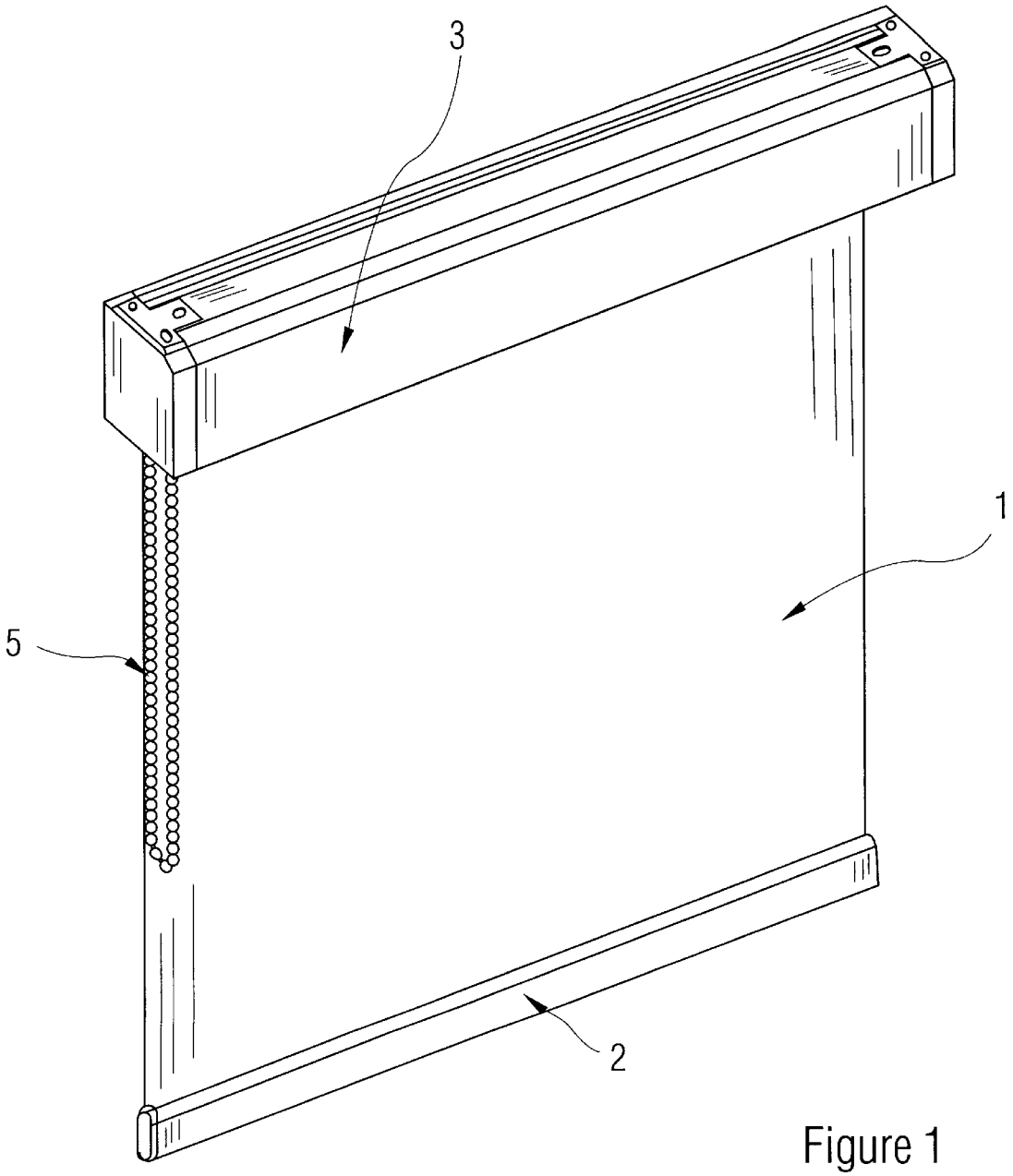
FIG. 1 is a perspective view of a cassette blind.

Referring to the drawings and in particular to FIG. 1, the exemplary embodiment shows a cassette blind, in which a set of blinds 1 includes a weighting profile 2 attached to the lower edge of which. The blind 1 can be wound up within a cassette profile 3 on a winding shaft 4 mounted therein.

Most often drive members are used which are arranged on one end within the winding shaft 4 and are actuated by a drive chain 5 led out of the cassette profile 3 on the side next to the blinds 1, are used for this purpose. It is also possible to have a motor-type drive means. Cassette blinds according to the present invention differ from roller blinds in that the blinds 1 are wound up on the winding shaft 4 by driving forces rather than by a torsion spring tensioned during the pulling down of the blinds.

The present invention includes a drive member 6 which can be rotated by the drive chain 5. On the one hand, coupling members, which make possible a non-rotatable connection between the drive member 6 and the winding shaft 4 for pulling up the blinds 1, are provided between the drive member 6 and the winding shaft 4. On the other hand, pin coupling means, such as braking members, by which the winding shaft 4 is stopped as driving forces in the direction of winding up cease to act on the drive member 6, are provided between the winding shaft 4 and a stationarily anchored pin 7.

In the exemplary embodiment, the drive member 6 is mounted movably concentrically within a tubular housing 8, with its angle of rotation limited by stops. The angle of rotation is limited by stops 9 on the inner jacket of the tubular winding shaft 4 and by stops 10 on the outer jacket of the housing 8. Brake disks 11 and 12, which are alternately connected non-rotatably to the pin 7 and non-rotatably to the tubular housing 8, are arranged axially displaceably on the pin 7. The assembly consisting of the brake disks 11 and 12 is supported at one end by an abutment 13 arranged rigidly on the pin 7. The end disk 14 at the opposite end has an axial cam, which cooperates with an axial cam at an intermediate member 15 such that the assembly consisting of the brake disks 11 and 12 is released during a rotary movement of the drive member 6 in the winding-up direction of the blinds 1 and compressed by the axial cams at the beginning of a rotary movement in the opposite direction. The pin coupling means thus blocks rotation in an unwinding direction and rotatably connects the winding shaft to the stationary pin in the winding direction. In such pin coupling means the winding shaft is rotatable through a switching angle in the unwinding direction with respect to the stationary pin before the pin coupling means engages the stationary pin with the winding shaft to block rotation in the unwinding direction. The switching angle is greater than zero. The pin coupling means rotatably connects the winding shaft to the stationary pin in the winding direction. A similar device is known from U.S. Pat. No. 5,443,109 which is hereby incorporated by reference.

A coupling member 16, which is non-rotatably connected to the housing 8, is connected movably over an angle of rotation against a torsion spring 17 to a sleeve 18, which is connected to the winding shaft 4 axially movably but non-rotatably. The outer sleeve 18 is non-rotatably connected to the winding shaft 4, and the inner sleeve or coupling member 16 is connected rotatably between stops to the drive member 6. Together the drive coupling member 16 and the spring 17 form a drive coupling means with the spring 17 having one end connected to said winding shaft and an opposite end connected to the drive member. The tubular housing 8 and coupling member 16 can be considered to be part of the drive member when the drive member 6 is non-rotatably connected to the housing 8. The spring biases the winding shaft ahead of said the drive member in a winding direction of the winding shaft over a predetermined angle.

Pin-like radial projections of the sleeve 18 engage profiled grooves of the stops 9 on the inner circumference of the tubular winding shaft 4. One end of the torsion spring 17 is attached to the coupling element 16, and the other end of the torsion spring 17 is attached to the sleeve 18. The torsion spring 17 is tensioned during a rotary movement of the drive member 6 in the winding-up direction of the blinds 1.

Figure 2:
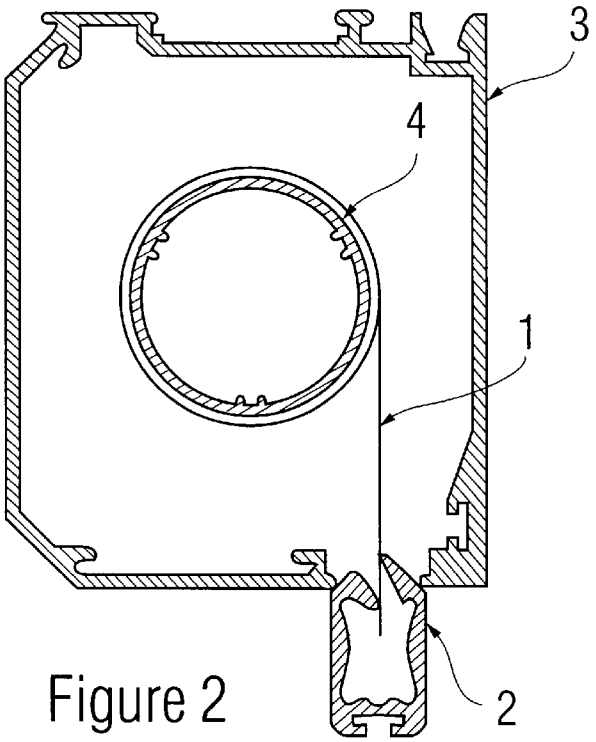
FIG. 2 is a cross section through the cassette profile of the pulled-up blinds.

The biasing force of the spring is chosen so that the weight of the blinds overcomes the maximum spring tension in almost all partially unwound positions except the topmost partially unwound positions. This causes the tubular housing 8 and the tubular winding shaft 4 to reach a stop position defined by the stops 9 and 10 in all but the topmost partially unwound positions. The torsion spring 17 begins to act at the top end of the rolling-up movement of the blinds 1 such that it rotates the winding shaft 4 in a leading manner with respect to the drive member 6 in the winding direction. The amount that the winding shaft leads the drive member at completion of winding is greater than the switching angle of the pin coupling means. This allows the drive member 6 to be able to still rotate further when the weighting strip has already occupied the position shown in FIG. 2 and is in contact with the cassette profile 3. The stops 9,10 are biased apart by the spring and are actually moved apart at the topmost partially unwound position. In this position further rotary movement of the winding shaft 4 is blocked, but the drive member can advance. To avoid overstretching of the torsion spring 17, the possibility of further damaging rotation is limited by another side of stops 9 and 10 contacting each other between the winding shaft 4 and the housing 8.

Figure 3:
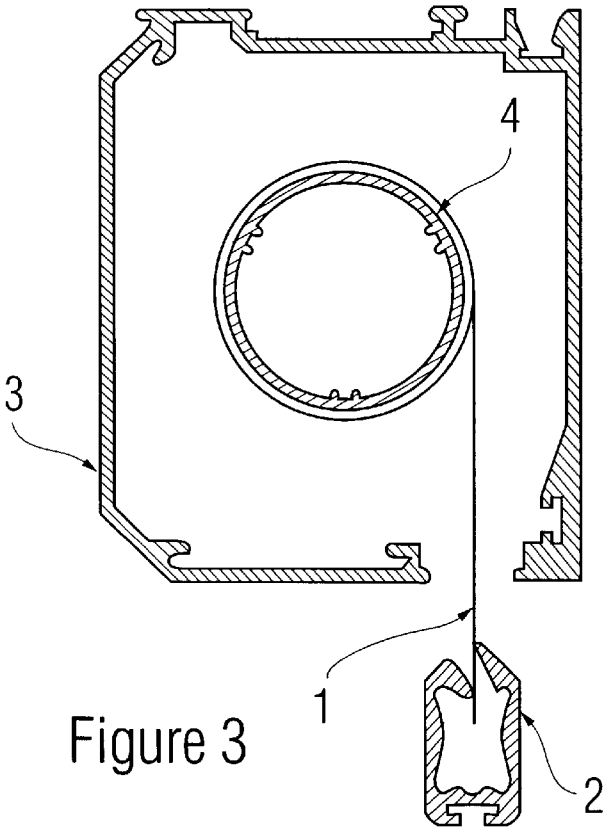
FIG. 3 is a cross section corresponding to FIG. 2 according to a design according to the state of the art.
Figure 4:
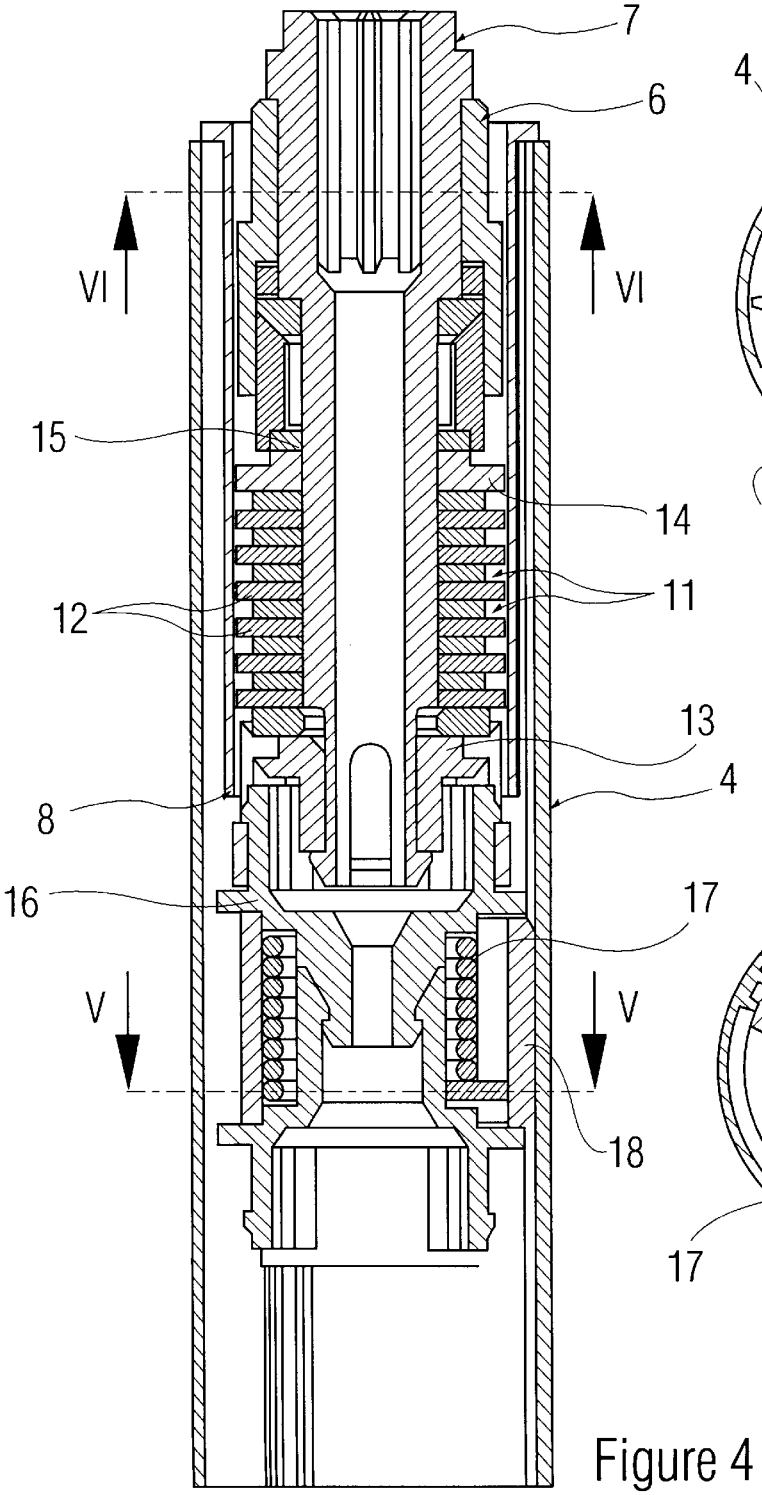
FIG. 4 is a longitudinal section through the drive-side end of the winding shaft in an axial plane.
Figure 6:
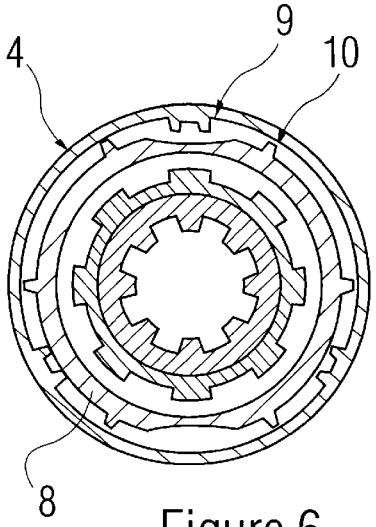
FIG. 6 is a cross section along line VI—VI in FIG. 4.
Figure 5:
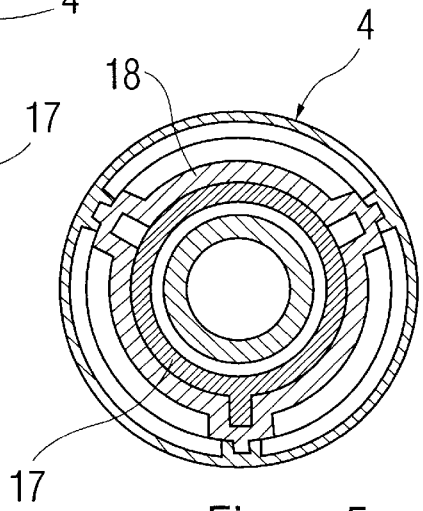
FIG. 5 is a cross section along line V—V in FIG. 4.

In order for the assembly consisting of the brake disks 11 and 12 to exert its braking effect, a slight backward rotation of the drive member 6 is needed. This rotation of the drive member now takes place within the advance distance of the drive member with respect to the winding shaft caused by spring tension. In this way the weighting profile 2 cannot drop back into the undesired position shown in FIG. 3. The magnitude of the advance, or the angle limited by the stops 9 and 10, should be greater than the angle of rotation necessary for the engagement of the braking elements, so that the weighting profile 2 is held against the cassette profile 3 in the position shown in FIG. 2 with a slight spring tension. The coupling element 16 non-rotatably connected to the tubular housing 8 is also designed in the exemplary embodiment as a sleeve, on which the sleeve 18 is arranged concentrically.

The application of the features of the present invention is not limited to cassette blinds, but these features may also be applied to blinds with a drive member that can be actuated whenever the resting position of the blinds after actuation of the blind is to be reached at an exactly predetermined point, e.g., in order to avoid or achieve the coverage of slots, or to make it possible to represent special images with the blinds.

While specific embodiments of the invention have been shown and described in detail to illustrate the application of the principles of the invention, it will be understood that the invention may be embodied otherwise without departing from such principles.

LIST OF REFERENCE NUMBERS:

| | |
|---|---|
| 1 Blinds | 10 Stop |
| 2 Weighting profile | 11 Brake disk |
| 3 Cassette profile | 12 Brake disk |
| 4 Winding shaft | 13 End disk |
| 5 Drive chain | 14 End disk |
| 6 Drive member | 15 Intermediate member |
| 7 Pin | 16 Coupling element |
| 8 Housing | 17 Torsion spring |
| 9 Stop | 18 Sleeve |

What is claimed is:

1. A cassette blind comprising:

a winding shaft;

a stationary pin including pin coupling means for engaging with said winding shaft in an unwinding direction of said winding shaft;

a drive member rotatably connected to, and rotatable with respect to, said winding shaft;

drive coupling means for engaging said drive member with said winding shaft, said drive coupling means including a spring means connected to said winding shaft and connected to said drive member, said spring means biasing said winding shaft ahead of said drive member in a winding direction of said winding shaft.

2. A cassette blind in accordance with claim 1, wherein:

said pin coupling means engages with said winding shaft in said unwinding direction to block rotation of said winding shaft in said unwinding direction.

3. A cassette blind in accordance with claim 2, wherein:

said spring means moves said winding shaft ahead of said drive means by a distance greater than said switching angle at a completion of winding.

4. A cassette blind in accordance with claim 1, wherein:

said winding shaft is rotatable through a switching angle in said unwinding direction with respect to said stationary pin before said pin coupling means engages said stationary pin with said winding shaft to block rotation L said unwinding direction.

5. A cassette blind in accordance with claim 4, wherein:

said switching angle is greater than zero.

6. A cassette blind in accordance with claim 3, wherein:

said spring means biases said winding shaft ahead of said drive member over a predetermined angle larger than said switching angle.

7. A cassette blind in accordance with claim 1, wherein:

said pin coupling means rotatably connects said winding shaft to said stationary pin in said winding direction.

8. A cassette blind in accordance with claim 1, wherein:

said drive coupling means rotatably connects said drive member to said winding shaft;

said spring means has a biasing force of a magnitude to cause said winding shaft to lead said drive member at a completion of winding.

9. A cassette blind in accordance with claim 1, wherein:

a blind is windable onto said winding shaft;

said spring means has a biasing force of a magnitude greater than a force caused by a weight of said blind when said blind is wound onto said winding shaft.

10. A cassette blind in accordance with claim 1, wherein:

said winding shaft experiences an unwinding force which increases as said winding shaft unwinds;

said spring means has a biasing force of a magnitude to overcome said unwinding force at a completion of winding of said winding shaft.

11. A cassette blind in accordance with claim 1, wherein:

said spring means is a torsional spring and one end of said torsion spring is fixed to said winding shaft and another end of said torsion spring is fixed to said drive member.

12. A cassette blind in accordance with claim 1, wherein:

said drive coupling means includes stop means for blocking rotation of said winding shaft with respect to said drive member in said unwinding direction, said stop means including stops on said drive member and said winding shaft which are in contact with each other prior to completion of winding;

said spring means biases said stops in a direction away from each other.

13. A cassette blind in accordance with claim 12, wherein:

said spring means moves said stops apart at a completion of winding.

14. A cassette blind in accordance with claim 12, wherein:

said winding shaft is rotatable through a switching angle in said unwinding direction with respect to said stationary pin before said pin coupling means engages said stationary pin with said winding shaft to block rotation in said unwinding direction, said switching angle is greater than zero;

said spring means moves said stops apart at a completion of winding by a distance greater than said switching angle.

15. A cassette blind in accordance with claim 1, wherein:

said drive coupling means includes stop means for blocking rotation of said winding shaft with respect to said drive member in said unwinding direction, said stop means including stops on said drive member and said winding shaft;

said spring means biases said stops in a direction away from each other, said spring means has a biasing force of a magnitude to cause said winding shaft to lead said drive member at a completion of winding, said magnitude of said biasing force being overcome and causing said stops to contact each other at a completion of unwinding.

16. A blind in accordance with claim 1, wherein:

said winding shaft is rotationally movable with respect to said drive member through said spring means.

17. A cassette blind comprising:

a winding shaft;

a stationary pin including pin coupling means for blocking rotation of said winding with respect to said winding shaft in a first rotational direction of said winding shaft, said pin coupling means rotatably connecting said stationary pin to said winding shaft in a second rotational direction of said winding shaft, said second rotational direction being opposite said first rotational direction a drive member rotatably mounted on said stationary pin and rotatably connected with respect to said winding shaft;

drive coupling means for rotatably connecting said drive member with said winding shaft, said drive coupling means including a spring means connected to said winding shaft and connected to said drive member, said spring means biasing said winding shaft ahead of said drive member in said second rotational direction of said winding shaft.

18. A blind in accordance with claim 17, wherein:

said winding shaft is rotationally movable with respect to said drive member through said spring means;

a drive chain is connected to said drive member for an operator to actuate said drive member.

* * * * *